US008327567B2

(12) United States Patent
Swick et al.

(10) Patent No.: US 8,327,567 B2
(45) Date of Patent: Dec. 11, 2012

(54) MULTIPLE FRAME TOPOLOGY SYSTEM

(76) Inventors: Nathan Lawrence Swick, Lexington Park, MD (US); Lori Glenn Swick, Lexington Park, MD (US)

( * ) Notice: Subject to any disclaimer, the term of this patent is extended or adjusted under 35 U.S.C. 154(b) by 61 days.

(21) Appl. No.: 12/870,832

(22) Filed: Aug. 29, 2010

(65) Prior Publication Data

US 2012/0047785 A1 Mar. 1, 2012

(51) Int. Cl.

| | |
|---|---|
| ***A47G 1/06*** | (2006.01) |
| ***A47G 1/16*** | (2006.01) |
| ***A47G 1/08*** | (2006.01) |
| ***G09F 7/00*** | (2006.01) |
| ***G09F 15/00*** | (2006.01) |
| ***G09F 15/02*** | (2006.01) |
| ***G09F 7/22*** | (2006.01) |

(52) U.S. Cl. ..... 40/729; 40/757; 40/790; 40/791; 40/739; 40/762; 40/606.11; 40/605; 40/617; 40/606.16; 40/745; 40/746; 40/612; 248/476; 248/495; 248/121

(58) Field of Classification Search ..... 40/729, 40/757, 790, 791, 739, 762, 606.11, 605, 40/617, 606.16, 745, 747, 612; 248/476, 248/495, 121

See application file for complete search history.

(56) References Cited

U.S. PATENT DOCUMENTS

| | | | | |
|---|---|---|---|---|
| 3,541,714 | A * | 11/1970 | Bruck, Jr. | 40/791 |
| 3,581,420 | A * | 6/1971 | Mollet et al. | 40/604 |
| 4,157,624 | A * | 6/1979 | Sobel | 40/759 |
| 4,588,190 | A * | 5/1986 | Stewart et al. | 473/435 |
| 4,643,384 | A * | 2/1987 | Guerin | 248/476 |
| 5,832,646 | A * | 11/1998 | Albin et al. | 40/762 |
| 7,412,792 | B2 * | 8/2008 | Hale | 40/791 |
| 2006/0201039 | A1 * | 9/2006 | Gilliland | 40/605 |

* cited by examiner

*Primary Examiner* — Tashiana Adams
*Assistant Examiner* — Syed A Islam
(74) *Attorney, Agent, or Firm* — Timothy P. Monaghan, Esq.

(57) ABSTRACT

A flexible, scalable multiple frame topology system capable of a wide range of multiple frame geometric topologies. Specifically a series of photographs, a series of photographic letters, or any series of flat, semi-flat, or three-dimensional display objects are displayable in a wide variety of display geometries: a horizontal line of frames, multiple, stacked, horizontal lines of frames, a vertical array of frames, multiple vertical arrays of frames, staggered arrays of frames, diagonal arrays of frames, crossword arrays of frames, and any combinations thereof. Also the disclosed display method is capable of displaying three-dimensional objects on shelves, or glass display cases, shadow boxes, on hooks, interlocking into the display cases—and the geometric display can mix a number of different display frames, for instance, a series of flat framed items with a three dimensional objects at each end of the array. Finally, the multiple clip frame system is a cost effective, visually balanced method, and aesthetically pleasing way to show any display object.

16 Claims, 8 Drawing Sheets

Top View

Side View

FIG 8
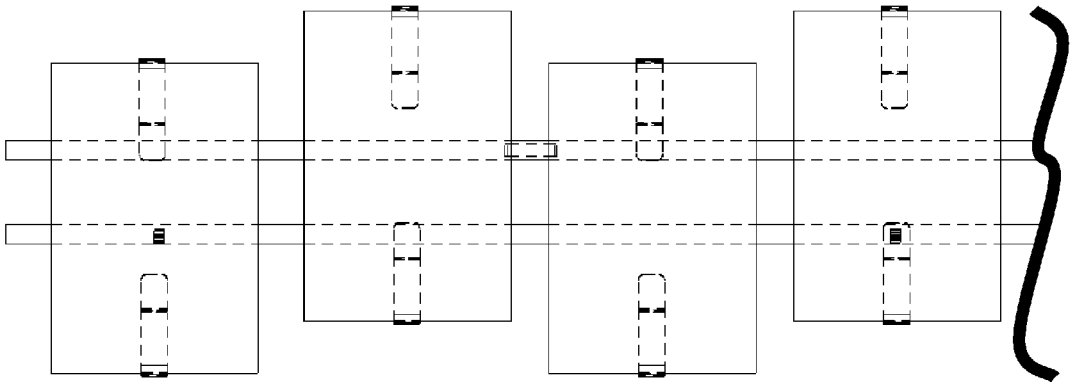
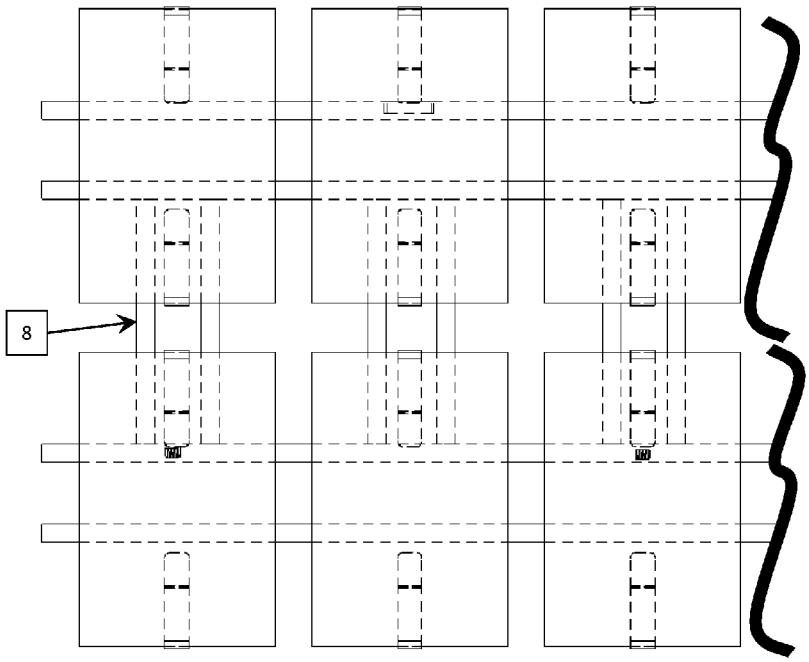
FIG 9

MULTIPLE FRAME TOPOLOGY SYSTEM

FIELD OF THE INVENTION

This invention relates a picture frame assembly in which multiple picture frames can be displayed in various geometric arrays. Specifically, the invention is a flexible, scalable picture frame display system capable of displaying a wide variety of display objects in a wide variety of geometric topologies—and does so in a cost effective and aesthetically pleasing manner.

BACKGROUND OF THE INVENTION

The initial motivation for the development for the disclosed multiple frame topology system was letter photography art. Letter photography art is pictures taken of objects that represent letters, photographs of commonly found objects or selected parts of those objects that look like a letter of the alphabet. For instance a tire could represent the letter "O." The individual photographs of letter-like objects are then arrayed in a series, a parallel array, a vertical array, and different array patterns to create a name, word, phrase or sentence in a unique geometric display.

There are two known prior display methods for letter photography art.

The first is a large single frame with cutouts in matting for the multiple photographs. Matting is a thick, decorative cardboard-like material. The size and display geometry within the matting is limited but very flexible within those limits. A letter art frame designer can cut out a wide variety of sizes and geometric displays within a large square of matting.

For use in letter photographs, the number of letter photographs are cut out in the matting locations where the letter art designer has chosen to display the photographs, each letter photograph has a window for it cut out in the matting, usually with a small matting border between letters. The letter photographs are then fit into each matting cut-out and the matting cut-outs frame the letter photographs within the large piece of matting.

The large square of matting containing the photographic letters is then framed. The frame surrounds the entire photographic array and gives the matting and photographs a polished look.

However, matting has a number of problems and limitations, mainly cost, size, and limited array variety. A single, large piece of high quality matting and the frame around that matting are expensive. The final framed letter array is large and bulky if the names, or sentences chosen have a significant number of letters. Finally, no other arrays are possible with a square of matting once that matting is cut to a certain geometric array. Also, only a limited amount of letter art geometric arrays are possible within an uncut square of matting.

The second framing method for letter photography art uses "clip frames" on a single thick rod. A single thick rod runs behind all the letter photographs to be framed and on that rod or board is a wall hanger.

Again, as with matting, clip frames have numerous problems. For example, the single thick rod tilts forward on the wall and does not appear visually balanced—it is not aesthetically pleasing. Also, the frame only displays photographs in a horizontal array. As with matting, the geometric array possibilities are very limited.

What is needed is a letter art framing system that provides a method, based on simple combination parts, that allows for a wide variety of geometric letter art arrays. The needed system displays those letter art pictures in an aesthetically pleasing manner—attractively displayed and easily read. Additionally, what is needed is a flexible display system that allows for wide variety of array geometries, but in a cost effective, inexpensive way—especially when compared to competitive, alternative letter art methods.

Surprisingly, during the development of the disclosed letter art display system, the inventive concept and its reduction to practice grew: the inventors developed a more general display system that allows for the display of a wide variety of display objects (flat, semi-flat, and three-dimensional objects) in a wide variety of geometric array topologies—for example from the display of a series of prize stamps in a unique array to the display of a series of prize butterflies arranged in a series of small glass cases.

However, this more general display system required a significant increase in flexibility and scalability: a display system design capable of displaying a wide variety of objects in a wide variety of geometric topologies and displaying those objects in a cost effective and aesthetically pleasing manner.

SUMMARY OF THE INVENTION

The present invention overcomes the difficulties described above by a simple method of interconnecting a plurality of frames on double rods, rods of any shape or material, and interconnecting them in a flexible geometric pattern of the display frames in an almost unlimited variety if geometric topologies, for example vertical, horizontal, staggered, and crossword shaped arrays of display frames.

An object of the invention simplicity. No matter how diverse the display objects and complicated the overall topology of the display the invention builds on a few simple principles, easy to implement to build the desired display.

The preferred embodiment of the invention uses dual rods, at least two backs mounted to the rods, flat pieces of glass approximately the same size as each back, and at least two clips (depending on the size of the back and glass frame) to sandwich the flat display object between the back and the glass.

It is yet another object of the simplicity of the invention to display the geometric display in a visually balanced, aesthetically pleasing manner. To meet this object bumpers are strategically placed on the lower rods, in the preferred embodiment, and the bumpers prevent the display frames from titling forward, keeping the displays vertically balanced with the wall.

As noted, yet another object of the invention is to provide a display system that has an unlimited range of geometrically shaped arrays of display frames. As will be displayed and described below this objective is met by building complicated display geometries based on the simple foundation design principles of the invention.

Thus, the invention provides a multiple frame topology system that is cost effective and hangs on the wall in an aesthetically pleasing combination.

Finally, it is an object of this invention to provide the objectives listed above, and others that will be apparent in the description of some embodiments of the invention, in a simple method of construction described below.

BRIEF DESCRIPTION OF THE DRAWINGS

For a more complete understanding of the various embodiments of the present invention and for further advantages and wide range of geometric topologies thereof, reference is now made to the following Description of the Preferred Embodiments taken in conjunction with the accompanying figures in which:

FIG. 8 illustrates a scalable, staggered view, alternate embodiment of the multiple frame topology system.

FIG. 9 illustrates the vertical-horizontal, scalable, alternate embodiment of the multiple frame topology system.

DESCRIPTION OF THE PREFERRED EMBODIMENTS

Figures 2, 3:
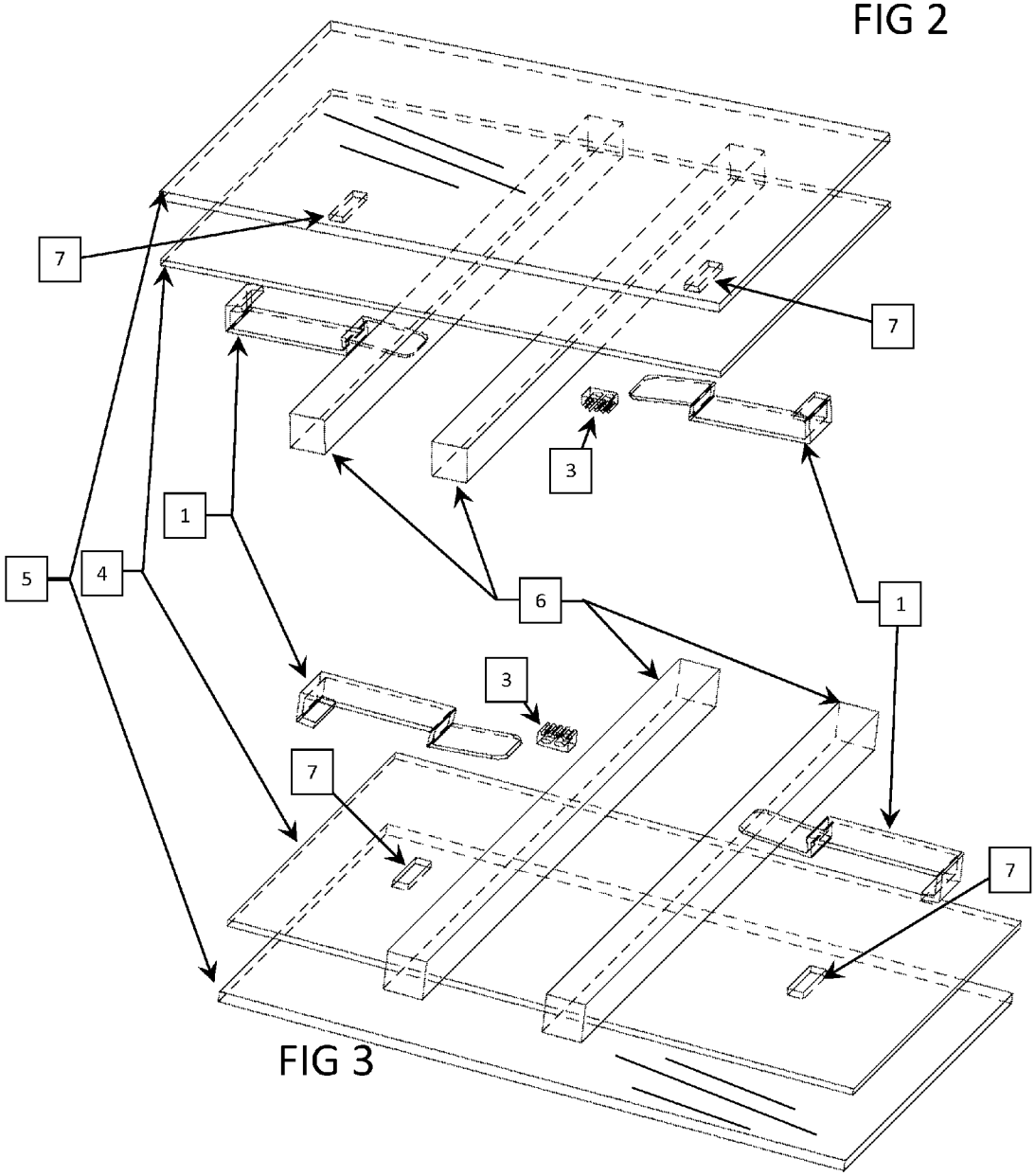
FIG. 2 is an exploded perspective of a single clip frame assembly, front view.
FIG. 3 is an exploded perspective of a single clip frame assembly, back view.

FIG. 2 is an exploded, perspective view, the front view, of one frame and all the parts of that part of the preferred embodiment. Clips 1 secure a flat display object between the backer 4 and the glass 5 and thus comprises one complete frame. A flat display object can be any, suitable, flat object like a photograph or letters in letter photography art. A bumper 3 is attached to the lower rod 6 (the purpose and placement of the bumper 3 will be detailed below).

FIG. 3 is also is an exploded, perspective view of all the parts of the preferred embodiment; it is the back view of the frame. The purpose and placement of parts are essentially the same as FIG. 2. A backer 4 is attached to the rods 6. A bumper 3 is on the lower rod 6. The clips 1 are on the top and bottom of the frame securing the glass 5 against the backer 4 and encasing the flat display object (such as artwork) between them.

Figure 1:
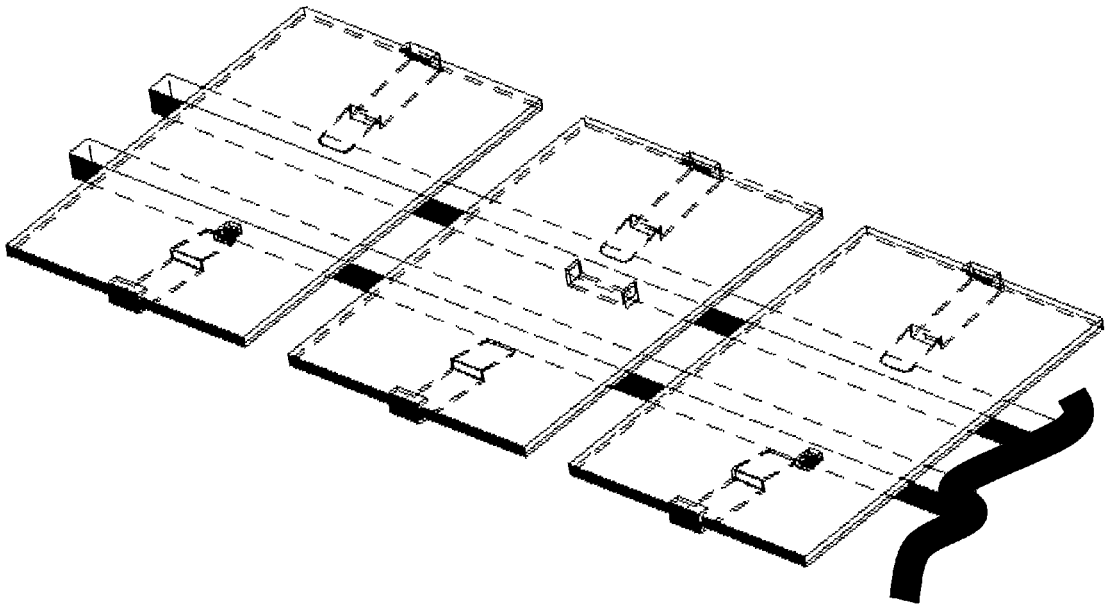
FIG. 1 is a perspective view of a three-frame embodiment of the multiple frame topology system.

FIG. 1 shows a perspective view of a horizontal array of a preferred embodiment having three frames of the same size. FIGS. 2 and 3 are exploded views of the front and back of one of one the three frames in FIG. 1. The FIG. 1 embodiment is the multiple frame topology system for mounting three display objects. FIGS. 2, 4, 5 and 6 show different views of the FIG. 1 embodiment. The thick, curved lines at the end of the rods shows in the figures shows the scalability of the design, i.e., the length of the rods and the amount of the backers are very flexible, scalable and entirely up to the frame designer.

For semi-flat display objects a suitable clip 1 capable for holding the display object onto the backer is required. If the display object is semi-flat one clip 1 may be all that is required to hold the displayed object to the backer 4.

However, if the display object is flat object like texts, family photographs, or the letters in letter photography art a suitable transparent material like glass 5 or clear plastic is desired to hold the flat objects against the backer 4.

Additionally, for a flat display object multiple clips 1 are used, in the preferred embodiment—one clip at the top and one at the bottom—and each clip has a notched area 7 in the rear of the backer to allow the clip to grip the backer 4. This notched area is not essential to the design but it is useful for keeping the backer 4, the clip 1, and the transparent material 5 stationary and securely in place.

To keep an embodiment using multiple frames parallel to the wall and give the entire frame array an aesthetically pleasing visual look it's desirable to have bumpers 3 attached to the lower rods 6 to keep the lower portion of the frame pushed out and parallel to the wall. Two bumpers 3 are shown in the FIG. 3 embodiment. The number of bumpers 3 depends on the size and overall geometric topology of the array. Enough bumpers 3 will keep even a large array of frames parallel to the wall, and prevent the array from leaning forward, giving the large array a pleasing aesthetic look.

Bumpers are optimally positioned on the lower rod, near the ends of the frame, behind the backers so they are hidden from the side or between the spaces between backers.

Another display option besides wall hangers and bumpers are easels. Easels can be used to display a finished geometric array instead of hanging the final geometric array of frames on a wall.

Propping the geometric array on a standard display easel will give the display the same level, aesthetic display. Displaying the geometric array of frames disclosed in this invention on an easel would allow it to be displayed on a flat, level surface such as a table, or fireplace mantle. Multiple easels can also be used, depending on length and preference of the display designer.

As to hanging an array of frames to the wall, any suitable wall hanger 2 is sufficient that will hang the overall array of frames level manner. Hangers are optimally positioned in the preferred embodiment on the upper rod in the middle on the three frame preferred embodiment, to balance the frame. There is no restriction on the type of wall hanger used. Placement of the wall hanger(s) 2 depends on the size and shape of the array. As with the bumpers 3, both the amount of wall hangers used and their placement simply depends on the final size and geometric topology of the final array of frames.

As to the size of the backers, still referring to the embodiment in FIGS. 1 to 5, there is no restriction on the size of the display objects. For example, four-foot long frames would simply add more support rods, and possibly bumpers and hangers depending on the length of the array.

Figure 4:
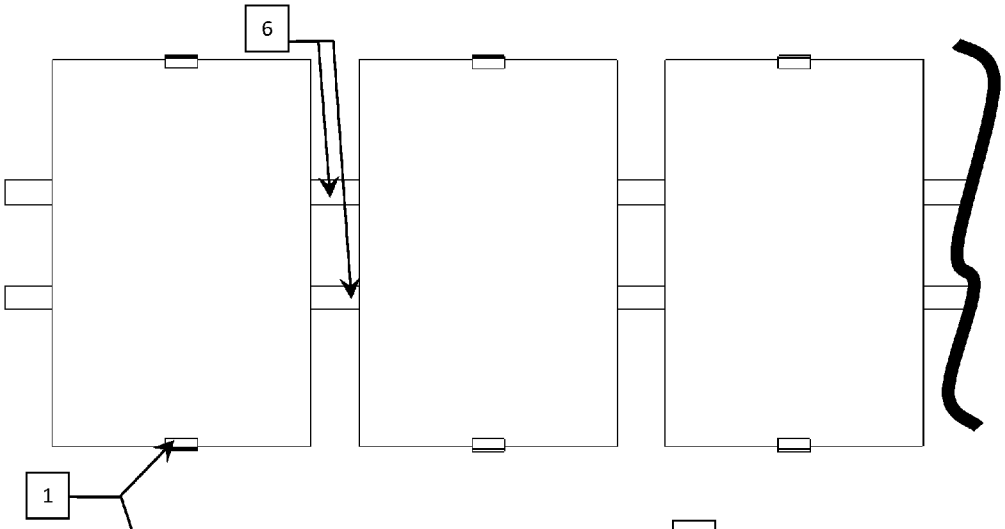
FIG. 4 is the front view of the three-frame embodiment shown in FIG. 1.
Figure 5:
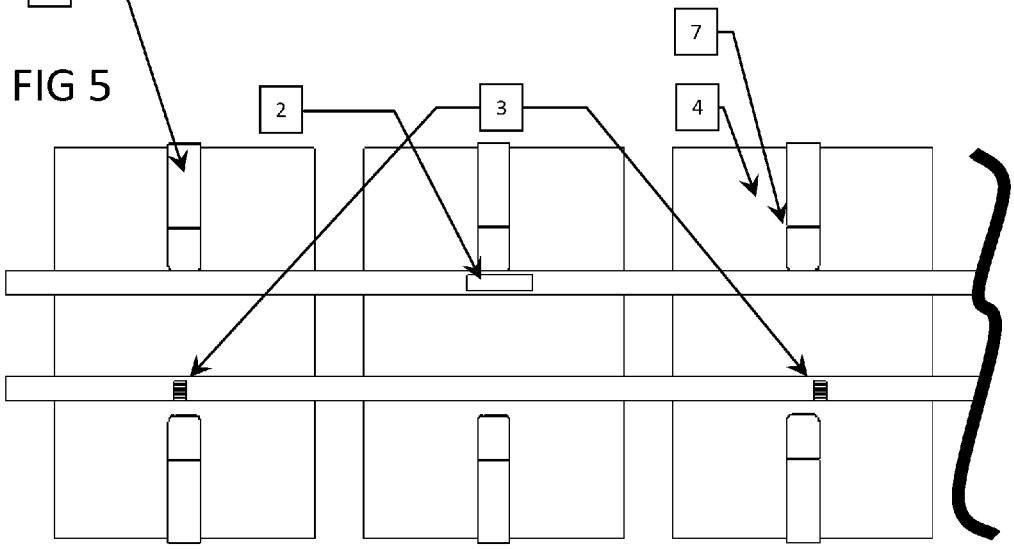
FIG. 5 is the back view the embodiment shown in FIG. 1.
Figure 6:
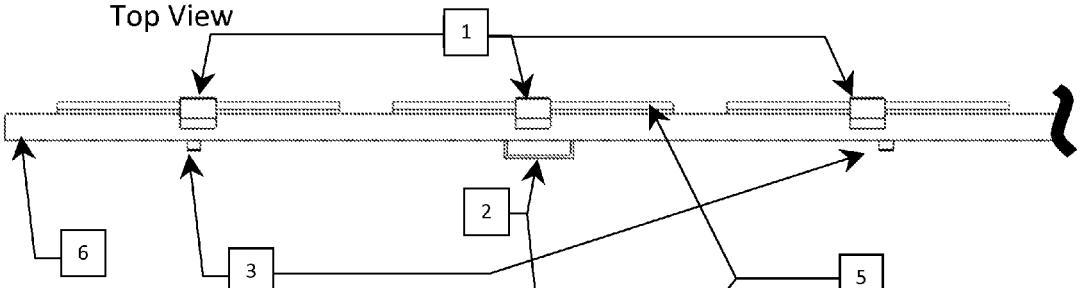
FIG. 6 is the top view of the embodiment of the multiple frame topology system shown in FIG. 1. The view illustrates the top of the frame system when it hanging on a wall and the viewer looks down on the top of the frame system.

Finally, FIGS. 4, 5, 6, and 7 show the FIG. 1 embodiment from different angles. FIG. 4 shows a front view of the three-frame embodiment of FIG. 1, that is, what the embodiment would look like hanging on the wall seen from the front. Flip FIG. 4 frame around and FIG. 5. is displayed, a view of the back of the FIG. 1 embodiment. FIG. 6 is a view of the FIG. 1 embodiment seen looking down at if from above, i.e., it is the top view of the embodiment.

Figure 7:
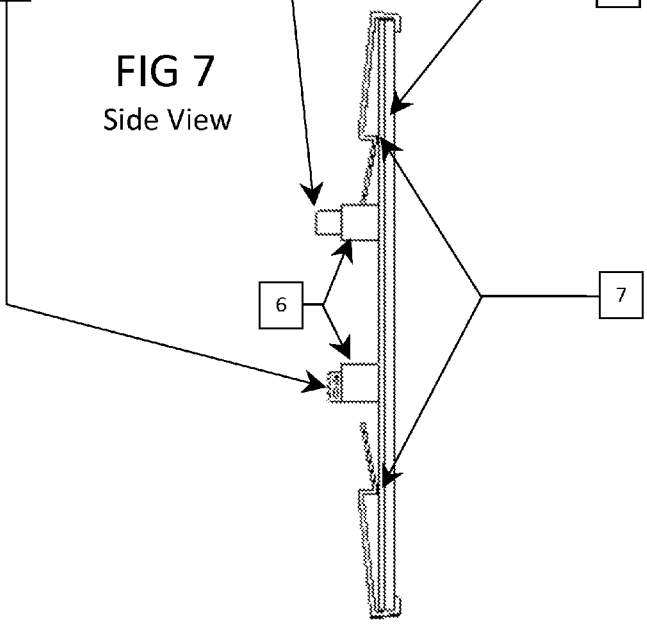
FIG. 7 is a left side view of the embodiment of FIG. 1.

FIG. 7 shows a side view of the FIG. 1 embodiment. The wall hanger 2 is on the top rod 6 and the bumper 3 is on the bottom rod.

Embodiments Displaying the Flexible, Scalable Nature of the Invention

FIG. 8 is an embodiment that illustrates the scalable nature of the invention. Four frames are used and used in a staggered configuration. The wavy, broken line on the far right of FIG. 8 (as well as in the other figures) signifies that the four frames can easily expand, or scale up to the desired number of frames.

As noted, depending on the number of frames and the overall geometry of the array, the wall hangers and bumpers can increase also. As noted, the rods also can expand if the frames are large in the vertical direction. In the horizontal direction two bumpers would be placed on the lowest backer, and two bumpers behind the middle backer.

Figure 10:
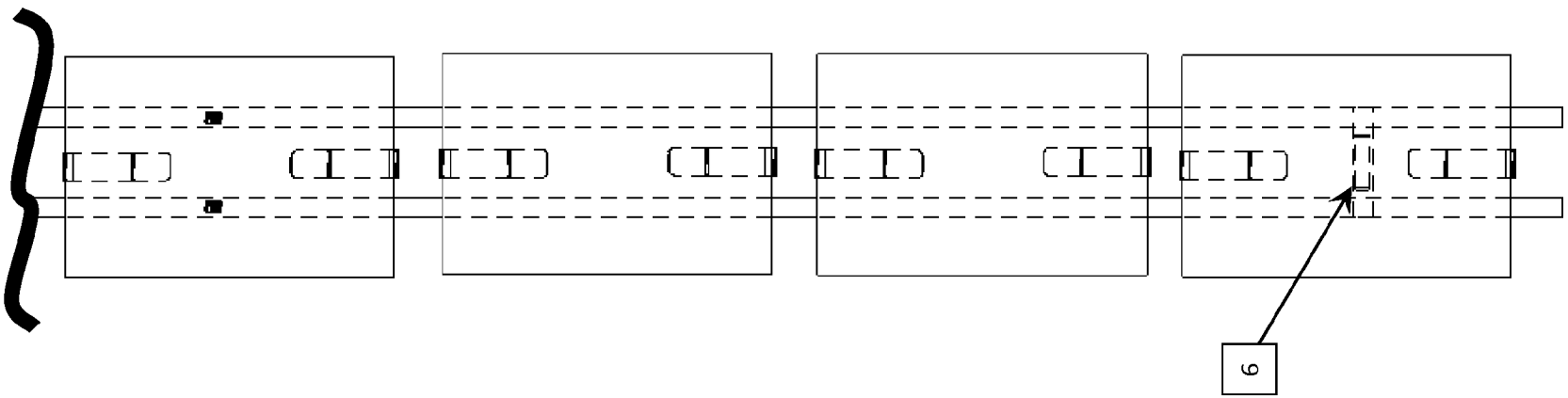
FIG. 10 illustrates the scalable, vertical frame, alternate embodiment of the multiple frame topology system.

FIG. 10 illustrates the scalability of the invention in both the vertical and horizontal directions. When adding another horizontal row of frames as in FIG. 10 vertical support connecting rods 8 are required to join the two horizontal rows together.

The vertical support rods 8 attach to rods 6 using any suitable joining means: for instance, small nails, high-speed staples, or glue. The same is true for the rods joining the backers, any suitable joining means is all that is required.

In the preferred embodiment the display object can be used to hide the means used to connect the backer to the rods. For instance, if high-speed staples are used to connect the rods to the backer the display object could be placed in front of the staples and hides them from view.

If a larger display object is used, for instance large, glass enclosed display cases—displaying objects such as a stamp collection or a butterfly collection—a suitable hook would be used to attach a glass encased display object to the backer 4 instead of a clip 1. The size and type of hook would depend on the display object. As part of the invention nothing special is claimed about the hook.

Also, when the semi-flat or three-dimensional objects, as noted above, the number of rods 6 would increase depending on the required size of the backers. For example, it is within the scope of this invention to display a series of LCD screens, hooked to the backers in a vertical or horizontal row or any other geometric topology disclosed in this invention.

Figure 11:
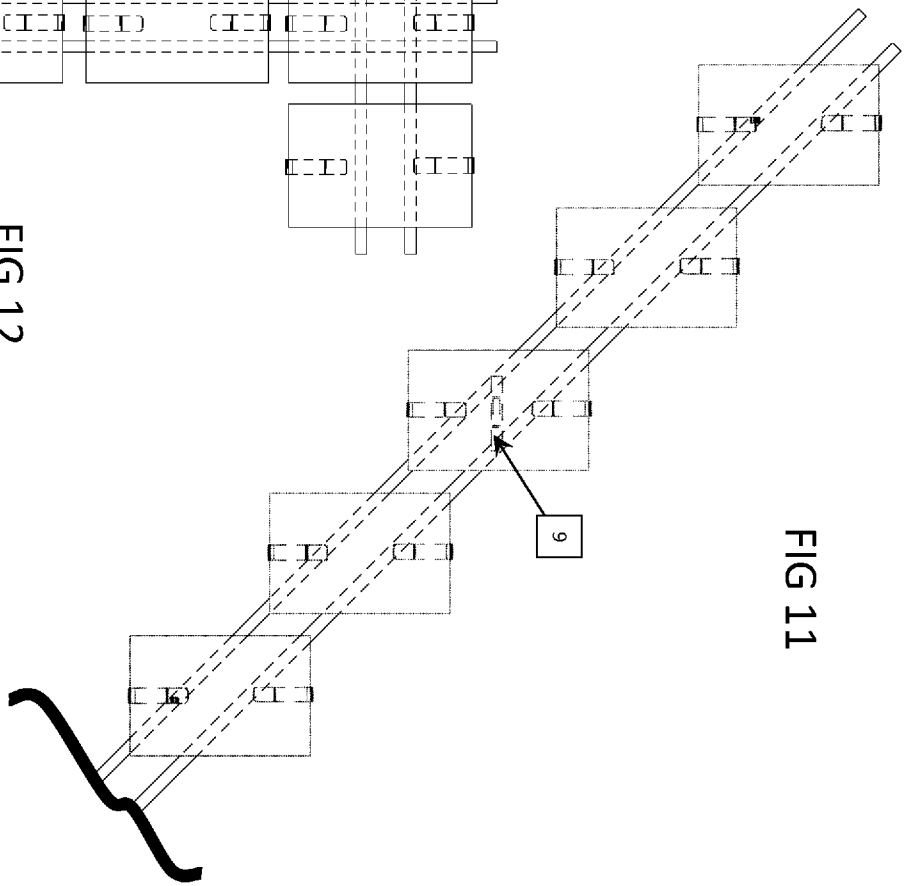
FIG. 11 illustrates the scalable, diagonal, alternate embodiment view of the multiple frame topology system.
Figure 12:
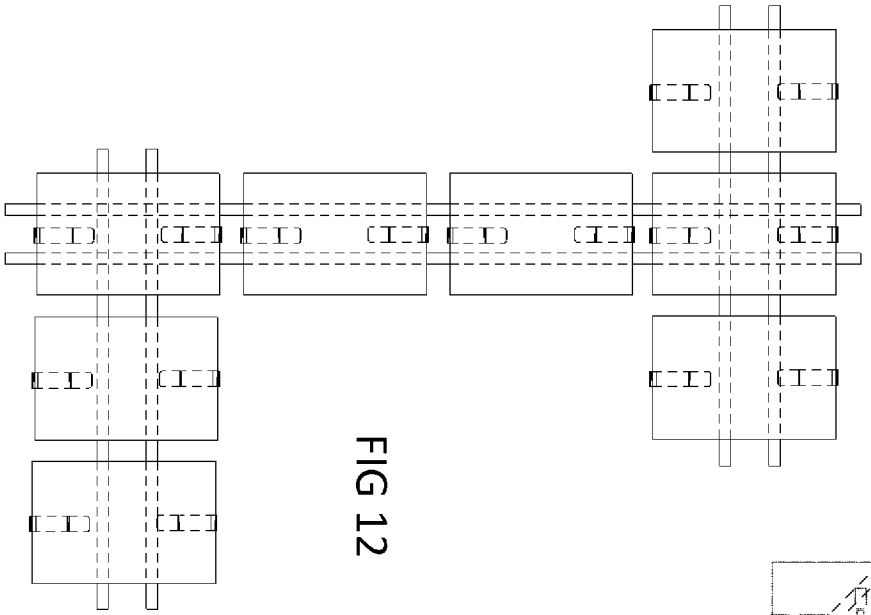
FIG. 12 illustrates the scalable, crossword, alternate embodiment view of the multiple frame topology system.

Finally, further embodiments of the flexible, scalable nature of the invention are shown is FIGS. 10, 11 and 12. FIG. 10 illustrates a vertical alternate embodiment of the multiple frame topology system. FIG. 11 illustrates the scalable, angled alternate embodiment, and FIG. 12 illustrates a cross-word embodiment view of the multiple frame topology system.

Figure 13:
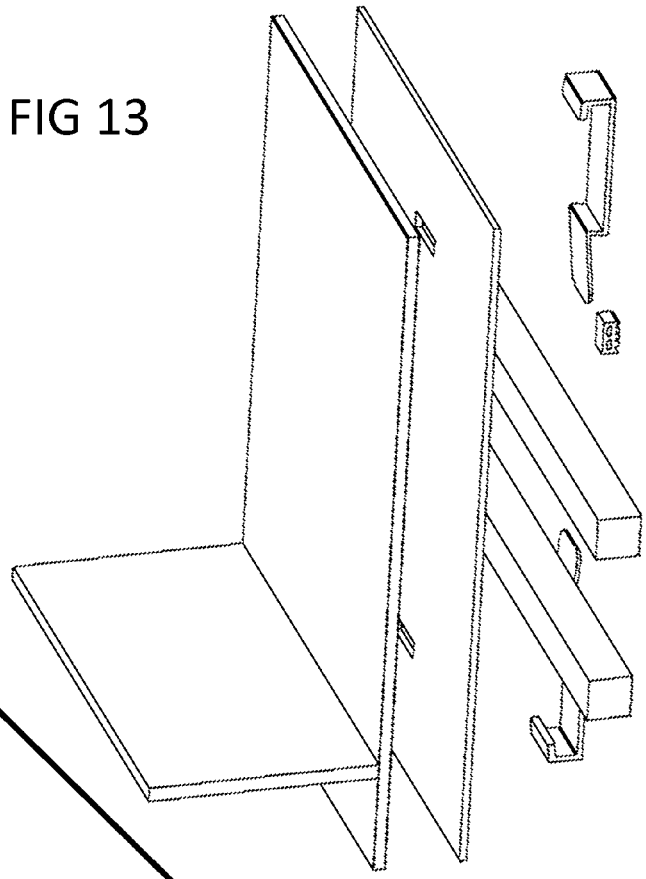
FIG. 13 illustrates one method of the disclosed system for displaying three-dimensional objects, a clip-on shelf accessory.

FIG. 13 shows a clip-on shelf embodiment. The shelf member and its back are fixed together by glue or some other suitable adhering means to form one unit. Then, the back and shelf as one unit are attached to the backer. Obviously, the shelf can hold a wide variety of three-dimensional objects. Additionally, as noted, one could size the shelf to fit the display object.

Also, as claimed, the shelf unit could be in a display mixed with flat display objects framed with glass, and even semi-flat objects clipped onto a backer. Nothing prevents the mixing of all or some of the different types of display frames (and thus display objects) in a geometric array, with a variety of topologic possibilities.

Figure 14:
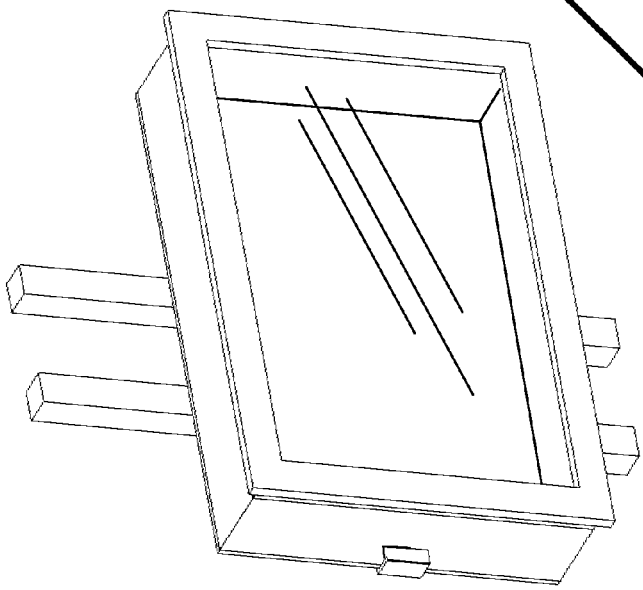
FIG. 14 illustrates another method of the disclosed system for displaying three-dimensional objects, a shadow box, a glass-enclosed display case.

FIG. 14 shows an embodiment that has hooks (hooks are not seen in the figure) fixed to the backer and the hooks interlock with the glass framed box, a shadow box, and holds the shadow box fixedly in place onto the backer.

Scalable, Multiple Frame Geometric Topologies

As noted, the disclosed multiple frame topology system is a cost effective, visually balanced way to display just about any flat, semi-flat, or three-dimensional object. The system can include in a geometric array of frames just about any display object within a reasonable size and visual nature for display purposes.

In assembling the various frame embodiments, there will normally be provided several clips or hooks depending on the nature of the display object. If it is desired to build up the embodiment illustrated in FIG. 1, two clips would be used on each frame, but the total number of clips per frame depends on the size of frames. If a single clip will hold a semi-flat or three-dimensional object, then only one clip would be used. If the display object is a display case a suitable hook would be used to hold the case in place. For greater rigidity of the overall assembly, more hooks could be used, suitably spaced.

As shown in the various embodiments, a wide variety of multiple frame geometric topologies can easily be built up using the simple interaction of the key components of the invention:

1) at a minimum one would use at least two rod members (rod members of any shape or suitable material), 2) at least one backer is attached to the rods, 3) at least one clip or hook is used with each backer, and 4) the clip or hook holds in place a wide variety of display objects.

A person can build up various display arrays, geometric topologies, from those simple principles. To add visual balance to the invention bumpers would be used, optimally positioned on the lower rod, positioned so they are hidden from the side or between the spaces between backers. One would insert the backers at various desired locations around the double rod structure to build up the desired topology of an embodiment, as shown in the embodiments illustrated above.

A particular geometric array of pictures can thus be provided, for example a collage of family photographs or different words of letter photography art. The entire assembly may be then suspended from a wall by a single wall fastener or, if the geometric array of frames is large, two or more wall fasteners would be placed, for example, in the middle and in adjacent the corners of the uppermost surrounding frames. Also, as noted, easels are also an alternative method of displaying the final geometric array.

Every effort has been made in the above descriptions to show the full range of geometric display topologies that the simple, economic, and visually pleasing features of the invention provide, accordingly, the invention is not limited to the specific embodiments or arrangements set forth above, for illustrative purposes.

Obvious modifications and alterations to the embodiments will occur when reading and understanding the specification. The disclosed basic design principles for constructing a display of array frames is intended to include all such modifications and alterations within the scope of the appended claims or the equivalence thereof.

What is claimed is:

1. A multiple frame topology system comprising:

(A) multiple photographs each photograph having front and rear sides;

(B) multiple backers and transparent members each having front and rear sides;

(C) multiple clips, each clip having a front member, a back member, and pressure between the front and back members;

(D) a pair of rods, one upper rod and one lower rod, each rod having two ends, both rods are approximately parallel to each other, the rods attached to the rear side of each backer, and the rods hold together all frames in the multiple frame topology system;

(E) the front of the backer placed against the rear side of the photograph, the rear of the transparent member placed against the front side of the photograph, the front member of at least one clip placed on the front of the transparent member and the back member of at least one clip placed on the rear of each backer, the clips having enough pressure to hold each photograph firmly between backer and transparent member but the pressure allows the clips to slip off the framed transparent member, photograph, and backer, providing easy implementation and building of other displays; and (F) at least two semi-soft bumpers attached near the ends of the lower rod, keeping the lower portion of the multiple frame topology system pushed out, parallel to the wall, and giving the entire frame system a pleasing aesthetic look.

2. The multiple frame topology system of claim 1 wherein at least one picture frame hanger is spaced evenly on the upper rod and balances the multiple frame topology system on a wall.

3. The multiple frame topology system of claim 2 wherein the picture frame hangers are saw-tooth hangers.

4. The multiple frame topology system of claim 1 wherein the transparent member is glass.

5. The multiple frame topology system of claim 1 further comprising an easel to display the multiple frame topology system.

6. The multiple frame topology system of claim 1 wherein the semi-soft bumpers are approximately three inches from the ends of the lower rod.

7. The multiple frame topology system of claim 1 further including notched areas on the rear of the backers, the clips on each frame engage the notched areas griping the backer and keeping the backer, clips, and display photograph secure and stationary.

8. A horizontally scalable, letter photography art, multiple frame topology system comprising:

(A) multiple letter photography art photographs having front and rear sides;

(B) multiple backers and transparent members having front and rear sides;

(C) multiple clips, each clip having a front member, a back member, and pressure between the front and back members;

(D) a pairs of rods, one upper rod and one lower rod, each rod has two ends, the rods are approximately parallel to each other;

(E) at least one picture frame hanger is spaced evenly on the upper rod and balances the multiple frame topology system on a wall;

(F) at least two semi-soft bumpers attached near the ends of the lower rod, keeping the lower portion of the multiple frame topology system pushed out, parallel to the wall, and giving the entire frame system a pleasing aesthetic look;

(G) the rear side of the transparent members placed on the front side of each letter photography art photograph, the front side of the backers placed on the rear side of each letter photography art photograph, (i) the front member of at least one clip placed on the front side of the transparent member, the rear member of at least one clip placed on the rear side of the backer, and (ii) the clips having enough pressure to hold each photograph firmly between backer and transparent member but the pressure allows the clips to slip off a framed transparent member, photograph, and backer, providing easy implementation and building of letter photography art displays; and (H) increasing the length of the horizontally scalable, letter photography art, multiple frame topology system to accommodate a longer letter photography art word by increasing the length of the rods, adding additional framed transparent members, photographs, and backers to accommodate the longer letter photography art word, and adding additional bumpers and picture frame hangers as needed to support the increased length and weight of the horizontally scalable, letter photography art, multiple frame topology system.

9. The multiple frame topology system of claim 8 wherein bumpers are placed behind the backers.

10. The multiple frame topology system of claim 8 further including notched areas on the rear of the backers, the clips engage the notched areas to grip the backer and keep the backer, the clip, and the letter art photograph stationary and securely in place.

11. The multiple frame topology system of claim 8 wherein the transparent member is plastic.

12. The multiple frame topology system of claim 8 wherein the transparent member is glass.

13. The multiple frame topology system of claim 8 further comprising an easel to display the multiple frame topology system.

14. The multiple frame topology system of claim 8 wherein multiple letter photography art words are formed by the multiple frame topology system.

15. The multiple frame topology system of claim 8 wherein picture frame hangers are spaced evenly on the upper rod depending on the size and length of the multiple frame topology system.

16. The multiple frame topology system of claim 8 wherein picture frame hangers are saw-tooth hangers.

* * * * *